US006408470B1

(12) United States Patent
Powers

(10) Patent No.: US 6,408,470 B1
(45) Date of Patent: Jun. 25, 2002

(54) ADJUSTABLE MATERNITY MATTRESS

(76) Inventor: Robert Lee Powers, 4553 Windchime Cove, Memphis, TN (US) 38128

( * ) Notice: Subject to any disclaimer, the term of this patent is extended or adjusted under 35 U.S.C. 154(b) by 0 days.

(21) Appl. No.: 09/481,700

(22) Filed: Jan. 12, 2000

(51) Int. Cl.[7] ..... A47C 17/00
(52) U.S. Cl. ..... 5/735; 5/631; 5/690; 5/930
(58) Field of Search ..... 5/631, 735, 930, 5/632, 731, 690

(56) References Cited

U.S. PATENT DOCUMENTS

| | | | | |
|---|---|---|---|---|
| 3,988,793 A | * | 11/1976 | Abitbol | 5/631 |
| 4,021,872 A | * | 5/1977 | Powell | 5/631 |
| 4,973,034 A | * | 11/1990 | Michele | 5/631 |
| 5,400,449 A | * | 3/1995 | Satto | 5/631 |
| 5,647,076 A | * | 7/1997 | Gearhart | 5/631 |
| 5,679,040 A | * | 10/1997 | Bianchi-Holm | 5/930 X |

FOREIGN PATENT DOCUMENTS

| | | | | |
|---|---|---|---|---|
| FR | 2687294 | * | 2/1992 | 5/631 |

* cited by examiner

*Primary Examiner*—Lynne H Browne
*Assistant Examiner*—James M. Hewitt

(57) ABSTRACT

An improved maternity mattress has a recess formed therein which accommodates a woman's expanding abdomen as a pregnancy progresses. The recess may be filled in by a plurality of stackable pads with each pad having approximately the same thickness. A sliding cover sized to allow for selectively covering and uncovering the hole is preferably controlled by an electrically powered mechanism, and may also be used to vary the diameter of the opening to the cavity. A control panel having switches for operating the sliding cover is preferably made of an expandable, flexible electrically insulating material such as rubber. A locking mechanism is provided to insure that the sliding cover remains closed.

5 Claims, 4 Drawing Sheets

ADJUSTABLE MATERNITY MATTRESS

BACKGROUND OF THE INVENTION

The present invention relates to a maternity mattress. More particularly, it relates to an improved maternity mattress having an adjustable cavity.

STATEMENT OF THE PRIOR ART

Maternity mattresses of various configurations are known in the art. While the prior art mattresses are generally satisfactory for performing their intended purposes, they tend to suffer from drawbacks.

U.S. Pat. No. 4,021,872 issued to Powell discloses a maternity mattress having a cavity for accommodating the abdomen of a pregnant woman as she lies upon the mattress in a prone position. A plurality of resilient disklike members are included and which jointly conform in size and shape with the cavity to normally fill the cavity but which may be removed one at a time as the pregnancy progresses to gradually increase the size of the cavity. Only the cavity depth is altered by adding or removing the disklike members. By contrast, the present invention contemplates a maternity mattress having a cavity for accommodating the abdomen of a woman which takes into account the fact that the abdomen size increases in all directions. To that end, a plurality of stackable concentric foam pads are selectively removable from the cavity, and the diameter of the cavity opening may be adjusted as needed.

U.S. Pat. No. 4,489,452 issued to Lickert discloses a maternity mattress having a plurality of fluid filled cushions upon which a pregnant woman may rest her abdomen. By contrast, the present invention accommodates a woman's abdomen by providing and adjustable cavity which closely conforms to the abdomens as it progresses during the pregnancy.

U.S. Pat. No. 5,504,953 issued to Singer- Layton discloses a cushion for use by pregnant women. The cushion is composed of a soft, foam-like material having a central recess or cavity defined in a surrounding continuous ridge to provide an integral unitary construction. The ridge includes sidewalls joined at a front end by a neck and chin transverse end wall and joined as a rear end by a leg and knee support. Sloping wall sections join the sidewalls with the leg and knee support whereby a flat planar surface of the leg and knee support resides below the top surface of the sidewalls. Internal sloping walls connect the front and rear ends with the bottom of the recess or cavity. A cushioned insert is carried within the recess that is reversible and having opposite textured or contoured sides. By contrast, the present invention concerns a mattress for pregnant women having a cavity formed therein, where the cavity is contoured to conform to the shape of a pregnant woman's abdomen. A plurality of nestable foam pads have a progressive increasing diameter to correspond to the increasing diameter of the woman's abdomen during the advancing stages of pregnancy.

SUMMARY OF THE INVENTION

The present invention contemplates an improved maternity mattress having a recess formed therein which accommodates a woman's expanding abdomen as a pregnancy progresses. The recess may be filled in by a plurality of stackable pads with each pad having approximately the same thickness. A sliding cover sized to allow for selectively covering and uncovering the hole is preferably controlled by an electrically powered mechanism, and may also be used to vary the diameter of the opening to the cavity. A control panel having switches for operating the sliding cover is preferably made of an expandable, flexible electrically insulating material such as rubber. A locking mechanism is provided to insure that the sliding cover remains closed.

Accordingly, it is a principal object of the invention to provide a new and improved adjustable mattress apparatus.

Accordingly, it is an object of the invention to provide an improved adjustable mattress apparatus having a cavity formed therein for accommodating a pregnant woman's abdomen.

It is another object of the invention to provide an improved adjustable mattress apparatus wherein the diameter of the cavity opening may be manually or automatically adjustable.

It is another object of the invention to provide an improved adjustable mattress apparatus which uses a plurality of stackable pads in combination with a sliding cover mechanism to allow for varying both the diameter and the depth of the cavity within which a pregnant woman's abdomen may be placed.

Finally, it is a general object of the invention to provide improved elements and arrangements thereof in an apparatus for the purposes described which is fully effective in accomplishing its intended purpose.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
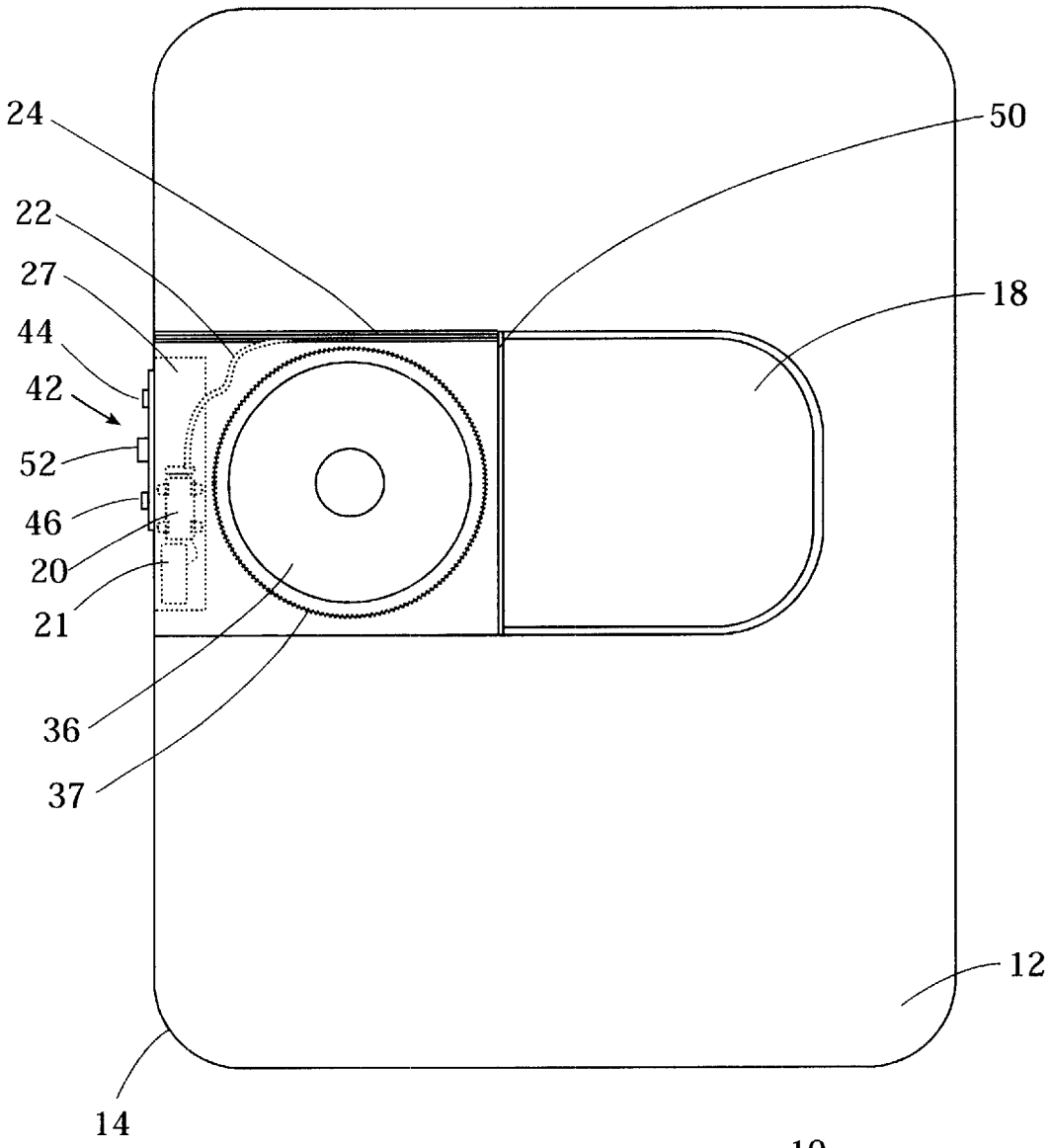
FIG. 1 shows a top view of a mattress formed in accordance with the principle of the present invention.

Referring now to FIGS. 1–5 an adjustable maternity mattress, formed in accordance with the invention and generally indicated by the numeral 10, is shown. The mattress 10 has a main body 12 preferably formed from any of the well-known foam materials and enveloped within a mattress tick 14. The main body 12 is provided with at least one cavity 15 which may have a generally circular horizontal cross-section as indicated by arrows 16, and which has a predetermined size and vertical cross-sectional shape for accommodating the abdomen of a pregnant woman as she lies upon the mattress 10 in a prone position, the woman being indicated in FIG. 2 by the reference numeral 17.

Disposed beneath the mattress tick 14 is a sliding cover 18 for selectively covering and uncovering cavity 15. Spacing is provided between the mattress tick 14 and the mattress padding to ensure smooth operation of the sliding cover 18. Padding, not shown, may be provided at the edge of the sliding cover 18.

The sliding cover 18 is preferably controlled by an electrical motor means 20 which may be disposed interiorly of the mattress. The motor 20 is disposed within a cavity having dimensions allowing for proper operation and cooling of the motor. The motor 20 is preferably a low power motor to avoid the fire hazard associated with 120 volt AC power. An adaptor (not shown) may be used to lower the voltage/current to reduce the shock hazard. Alternatively, a battery pack 21 may be used as a source of power for the motor. The motor 20 is operably connected to a worm drive assembly 22 which is connected to the sliding cover 18 to cause movement thereof. Any of several known arrangements may be employed to connect the worm drive 22 to the sliding cover as would be expedient to one of ordinary skill in the art. In accordance with a preferred embodiment of the invention, a single screw drive member 24 extends into a suitably sized and threaded internal bore 26 provided in the sliding cover 18. Appropriate rotation translation means such as pulley and gears may be provided depending upon the orientation of the of the output shaft 28 of the motor 20.

Figure 2A:
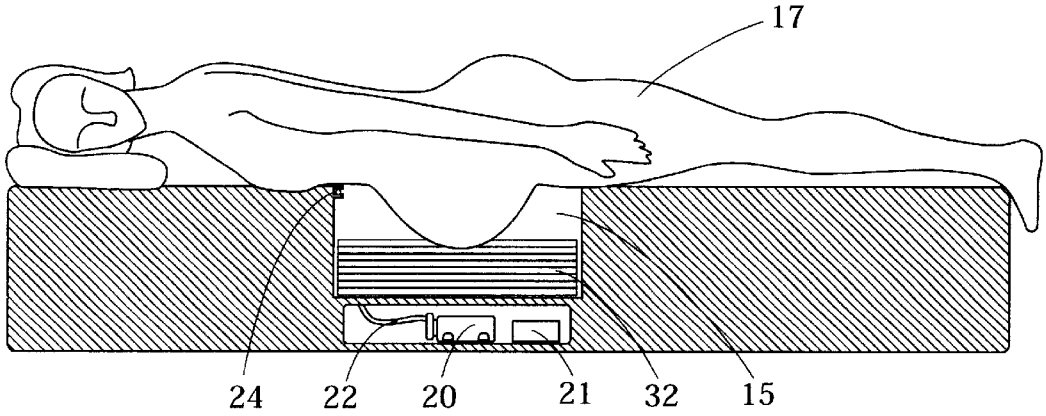
FIG. 2 shows a side view partly in section of the mattress of FIG. 1.
Figure 2B:
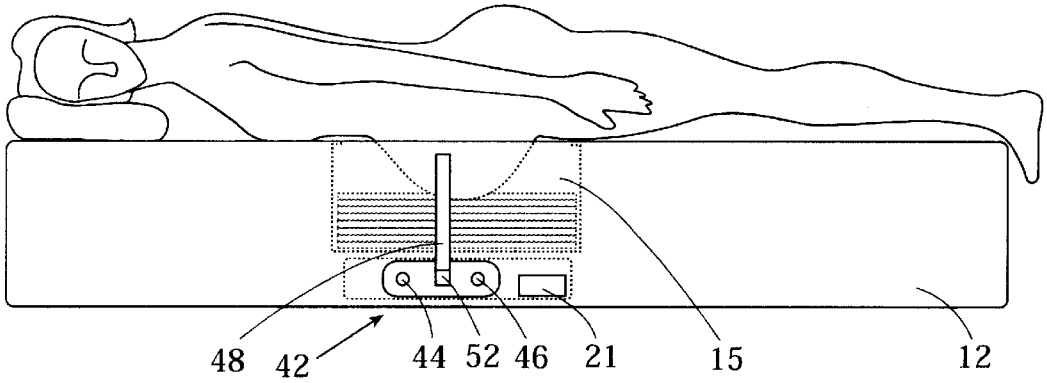
Figure 3:
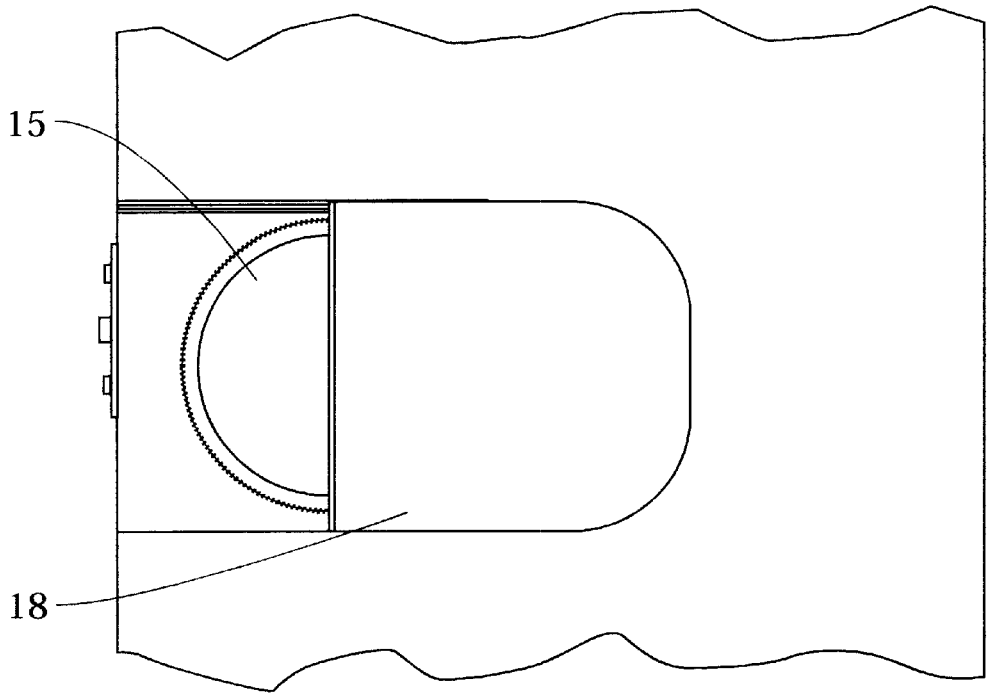
FIG. 3 shows a representation of a component for covering a recess formed in the mattress of FIG. 1.
Figure 4:
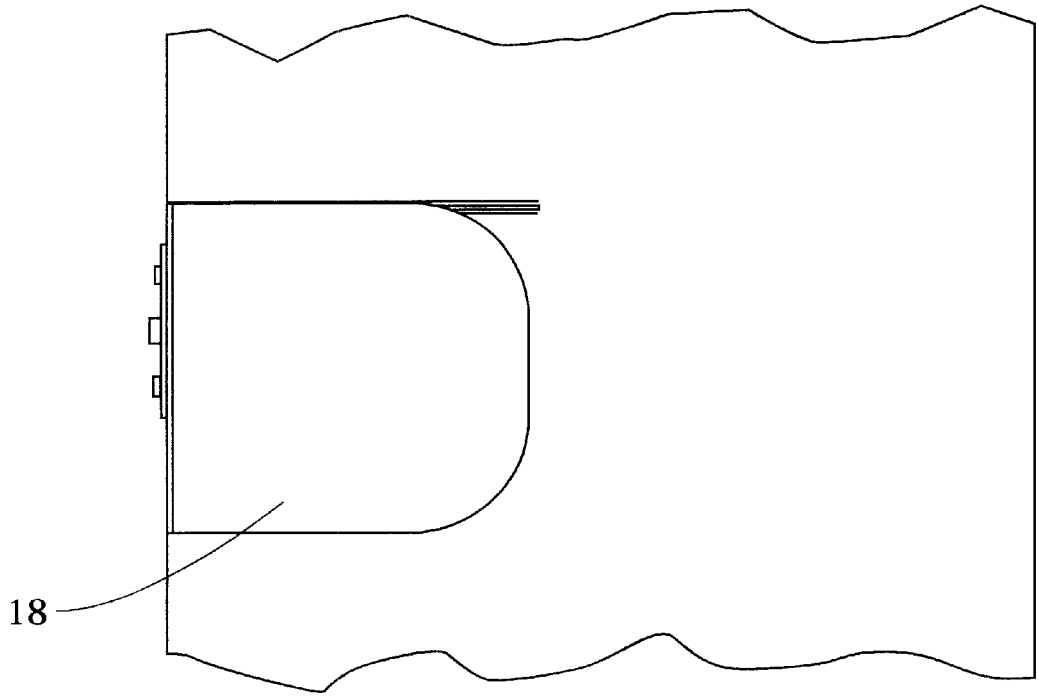
FIG. 4 shows a top view of the mattress of FIG. 1 detailing the covering for the opening for the recess.
Figure 5:
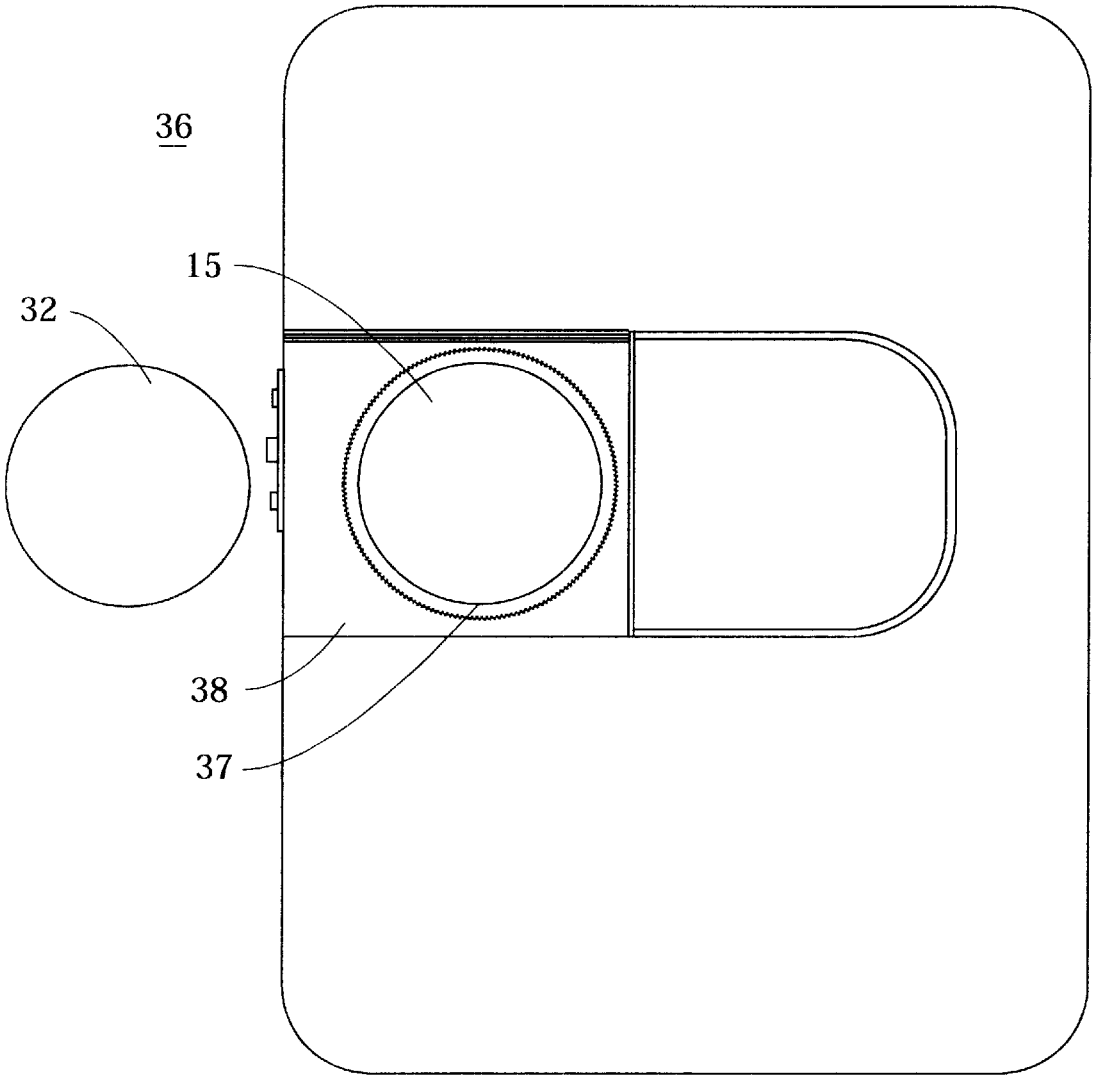
FIG. 5 discloses a top view of a mattress cover adapted for use with the mattress of the present invention.

Resilient filler means generally characterized by the numeral 30 are provided for filling the cavity 15 and for gradually changing the. size thereof The filler means 30 include a plurality of disklike members 32 jointly conforming in size and shape with the cavity 15 and normally being removably received therein with the disklike members 32 intended to be selectively removed from the cavity 15 as the pregnancy progresses thus gradually increasing the size of the cavity 15, as depicted in FIG. 2 of the drawing.

The disklike members 32 can only be removed/added when the cavity 15 is accessible. In accordance with a preferred embodiment of the invention, a cloth covering 36, in combination with the sliding cover 18, is used to selectively allow access to the cavity. The covering 36 may be a mattress cover padded in the area 38 of the cavity 15 in order to avoid a noticeable hard spot. The padded area 38 of the covering 36 may be a substantial portion of the top surface of the mattress tick 14, or may be used to cover the entire mattress. The covering 36 would have a zippered opening 37 allowing access to the cavity 15, the removable cloth cutout 39 could then be placed in the bottom of the cavity 15 until needed to re-cover the cavity. Preferably, padded area 38 would then extend at least to the area above the sliding cover 18 when the sliding cover is fully extended in the open position. Alternatively, the covering 36 would be a circularly shaped zippered cloth, with half of the zipper 37 being formed directly onto the mattress tick 14. Essentially, in accordance with this embodiment, the covering would be part of the mattress tick, using the same fabric and thickness for continuity. Thus when the mattress is used with the hole closed, the user would provide padding.

Once the covering 36 is removed, the sliding cover 18 may be slid as required in order to selectively allow access to the cavity 15. To that end, a control panel 42 is provided on the mattress 12 to effect activation of the motor 20 and worm drive assembly 22. The control panel 42 has two buttons thereon, a first button 44 for retracting the sliding cover 18, and a second button 46 for closing the sliding cover 18. A spring loaded safety lock assembly having a spring loaded latch 48, cooperates with a bar 50 which extends across the edge of the sliding cover 18, latching to the bar 50 when the sliding cover is closed. A switch 52 connected to the latch 48 pulls the latch out of latching engagement with the bar 50 allowing movement of the sliding cover 18. Thus it can be appreciated that two finger operation is required to move the sliding cover. This safety feature is useful to prevent accidental operation by small children.

In operation, the mattress 12 is stored with the covering 36 zippered into place. When it is desired to use the cavity 15, the covering 36 is removed and the sliding cover is operated using the controls. The disks 32 may then be removed as required so that the stomach of the pregnant woman W is accommodated. When the pregnancy ends, all of the disks 32 may be stored in the cavity. The covering 36 is zippered and the sliding cover 18 is replaced. It can be readily appreciated that sliding cover 18 may be adjustably opened to accommodate women having wider abdomens. The worm drive assembly 22 would tend to prevent movement of the sliding cover 18 unless the control panel 42 is operated.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A maternity mattress comprising:

a mattress having a foam material enclosed by a mattress tick, said mattress tick having an upper surface, and said foam material having a cavity with a predetermined effective depth and width formed therein;

a sliding cover contained within said mattress immediately adjacent said upper surface of said mattress, said sliding cover movable between an open and closed position;

a plurality of individual foam members insertable into said cavity to adjust the effective depth of said cavity;

means for moving said sliding cover to adjust the effective width of the cavity, said sliding cover moving means also including means for preventing accidental or unintended movement of said sliding cover.

2. The mattress of claim 1 wherein a latching means latches said sliding cover in a closed position.

3. The mattress of claim 2 wherein said means for preventing accidental or unintended movement of said sliding cover includes a button for activating said means for moving the sliding cover, and a switch for moving said latching means between latched and unlatched positions.

4. The mattress of claim 1 wherein said sliding cover may be adjusted to a plurality of widths.

5. The mattress of claim 1 wherein a zippered covering is attached to said mattress tick.

* * * * *